US006607036B2

(12) United States Patent
Ranson et al.

(10) Patent No.: US 6,607,036 B2
(45) Date of Patent: Aug. 19, 2003

(54) METHOD FOR HEATING SUBTERRANEAN FORMATION, PARTICULARLY FOR HEATING RESERVOIR FLUIDS IN NEAR WELL BORE ZONE

(75) Inventors: Aaron Ranson, Edo. Miranda (VE); Luis Carlos Genolet, Los Teques (VE); Douglas Espin, Caracas (VE); Juan Carlos Chavez, La Sienna Torree (VE)

(73) Assignee: Intevep, S.A., Caracas (VE)

( * ) Notice: Subject to any disclaimer, the term of this patent is extended or adjusted under 35 U.S.C. 154(b) by 0 days.

(21) Appl. No.: 09/796,761

(22) Filed: Mar. 1, 2001

(65) Prior Publication Data

US 2002/0121374 A1 Sep. 5, 2002

(51) Int. Cl.[7] ..... F21B 36/00; F21B 43/16

(52) U.S. Cl. ..... 166/302; 166/305.1; 166/272.1; 166/280; 166/57; 166/248

(58) Field of Search ..... 166/57, 59, 60, 166/248, 272.1, 272.2, 280, 302, 305.1

(56) References Cited

U.S. PATENT DOCUMENTS

| | | | | | |
|---|---|---|---|---|---|
| 3,149,672 | A | * | 9/1964 | Orkiszewski et al. | 166/248 |
| 3,547,193 | A | * | 12/1970 | Gill | 166/248 |
| 3,620,300 | A | * | 11/1971 | Crowson | 166/248 |
| 4,567,945 | A | * | 2/1986 | Segalman | 166/248 |
| 4,713,203 | A | * | 12/1987 | Andrews | 166/280 |
| 5,620,049 | A | * | 4/1997 | Gipson et al. | 166/248 |
| 6,148,911 | A | * | 11/2000 | Gipson et al. | 166/248 |
| 6,406,789 | B1 | * | 6/2002 | McDaniel et al. | 428/402 |

FOREIGN PATENT DOCUMENTS

| | | |
|---|---|---|
| WO | WO/98/22648 | 5/1998 |

* cited by examiner

*Primary Examiner*—David Bagnell
*Assistant Examiner*—T. Shane Bomar
(74) *Attorney, Agent, or Firm*—Bachman & LaPointe, P.C.

(57) ABSTRACT

A method for heating a subterranean formation includes the steps of positioning a well to a subterranean formation; disposing an energy transforming material in the formation; and exposing the material to energy whereby the material generates heat.

7 Claims, 1 Drawing Sheet

METHOD FOR HEATING SUBTERRANEAN FORMATION, PARTICULARLY FOR HEATING RESERVOIR FLUIDS IN NEAR WELL BORE ZONE

BACKGROUND OF THE INVENTION

The invention relates to a method for heating a subterranean formation and, more particularly, to a method for heating formation fluids in a well bore zone so as to reduce viscosity and improve fluid flow, thereby improving fluid production through the well.

Wells are drilled to subterranean hydrocarbon bearing formations in order to produce such hydrocarbons to the surface. Production through the well is guided by several factors, including formation pressure, fluid viscosity, formation permeability and the like.

A long standing endeavor in the industry is to improve flow rates from such hydrocarbon producing wells. Various methods such as formation fracturing, injection wells and the like have been used for such purpose.

Despite the foregoing, the need remains for further improvements in production flow rates.

It is therefore the primary object of the present invention to provide a method for improving hydrocarbon flow from subterranean formations.

It is a further object of the present invention to provide such a method which is readily applicable to different types of producing wells, without requiring substantial new equipment and the like.

Other objects and advantages of the present invention will appear hereinbelow.

SUMMARY OF THE INVENTION

In accordance with the present invention, the foregoing objects and advantages have been readily attained.

According to the invention, a method is provided for heating a subterranean formation, which method comprises the steps of positioning a well to a subterranean formation; disposing an energy transforming material through said well into said formation; and exposing said material to energy whereby said energy transforming material generates heat.

In accordance with a preferred aspect of the present invention, the energy transforming material is exposed to energy so as to generate heat while formation fluids are produced through the well, whereby such formation fluids are heated, and viscosity is reduced, so as to improve production flow rates.

BRIEF DESCRIPTION OF THE DRAWINGS

A detailed description of preferred embodiments of the present invention follows, with reference to the attached drawings, wherein.

DETAILED DESCRIPTION

The invention relates to a method for heating a subterranean formation and, thereby, for heating fluids in the subterranean formation so as to reduce viscosity of such fluids and improve flow rates through wells drilled to the formation.

Figure 1:
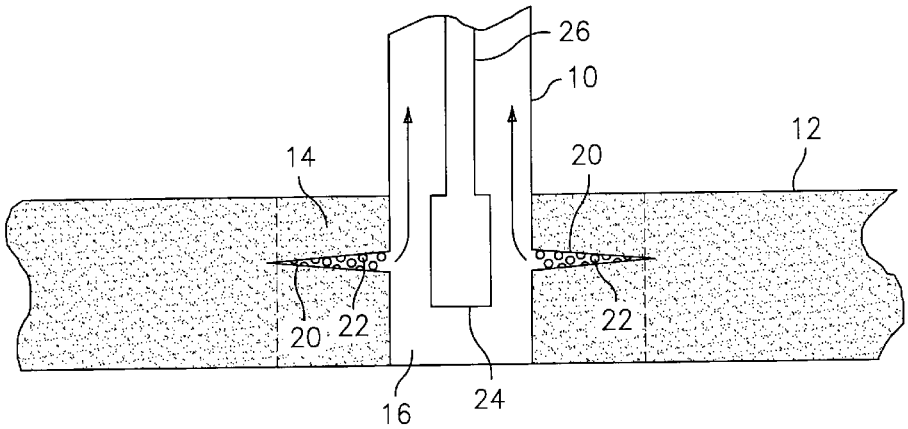
FIG. 1 schematically illustrates a method in accordance with the present invention.

FIG. 1 shows a well 10 positioned to a hydrocarbon bearing formation 12 for producing formation fluids to a surface level. In accordance with the present invention, and as will be further discussed below, certain materials are disposed in the formation in fractures or perforations 20 provided in the formation 12 at a zone 14 around the well bore 16, and such materials are selected of material which heats when exposed to energy. These materials are, according to the invention, exposed to energy such that heat is generated for heating formation 12, especially in the zone 14, and the fluids contained therein.

By heating fractures 20 and zone 14, viscosity of fluids is substantially reduced, thereby improving flow significantly and enhancing production from well 10.

Suitable material for use in heating will be referred to herein as energy transforming material, and includes materials which heat when positioned in magnetic, electric and/or electromagnetic fields.

In accordance with one preferred embodiment of the present invention, formation 12 has been subjected to a fracturing step so as to provide perforations or fractures 20, with proppants 22 disposed in fractures 20 to keep such fractures open and enhance flow rates into well 10. In accordance with this embodiment of the present invention, the energy transforming material may advantageously comprise nanoparticles and the proppant may be, for example, selected from (1) a cluster of the nanoparticles, (2) a conventional proppant coated with the nanoparticles or (3) nanoparticles located inside a proppant.

In one particularly preferred embodiment of the invention, such proppants can be prepared by soaking the proppant in a bath containing desired nanoparticles so as to completely coat the proppants, after which the proppants can be dried and positioned within fractures 20 in a conventional and well known manner.

By exposing such proppants to energy, the proppant heats, and fluids flowing through fractures 20 and proppants 22 disposed therein will be heated so to reduce viscosity and improve production flow rates.

In accordance with another aspect of the present invention, the energy transforming material may be positioned in the formation by means different than fractures. For example, some formations are perforated to enhance production, and energy transforming material can be disposed in such perforations. In this embodiment of the present invention, the nanoparticle containing proppants described above may themselves be disposed in such perforations, for example by flowing a proppant suspension through the well into the formation so as to dispose the desired proppant into the perforations, where they can be subjected to energy and heated as desired.

In further accordance with the invention, some formations are sufficiently loose, unconsolidated or highly permeable that the proppant can be forced into them without substantially impacting upon permeability of same. In such formations, the proppant containing or formed of the nanoparticles of the desired material can be disposed into the formation and subjected to energy as with the other embodiments so as to heat zone 14 and formation fluids contained therein, also resulting in reduction of fluid viscosity and improvement in production flow rates.

Still referring to FIG. 1, the energy transforming material disposed into fractures 20 in the various embodiments discussed above can be exposed to energy from any suitable power source 24, which is selected to provide the type of power to which energy transforming material will respond, and power source 24 may suitably be disposed through well 10 to the appropriate area, for example on any conventional tool string 26. Unit 24 may suitably be an apparatus for generating the desired electric, magnetic or electromagnetic field to which energy transforming material disposed in fractures 20 responds by generating heat.

Figure 2:
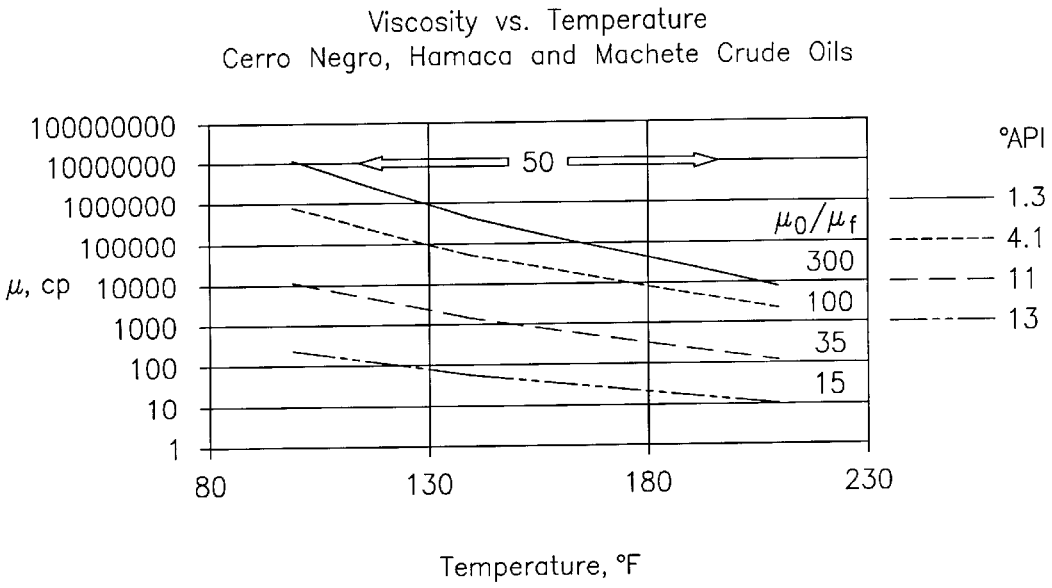
FIG. 2 illustrates the relationship between typical hydrocarbon viscosity for different grades of hydrocarbon and temperature.

The method of the present invention can provide for excellent reductions in fluid viscosity at relatively small amounts of power consumption. Desired temperature increases can be obtained at minimal energy input levels. Referring to FIG. 2, the viscosity for various grades of crude oil is shown as it relates to temperature. Clearly, an increase in temperature can provide significant reductions in viscosity of such fluids, which will lead to substantial improvements in flow rate.

The energy transforming material in accordance with the present invention is preferably provided in the form of nanoparticles, which can then be used as proppants prepared as described above. Suitable nanoparticles preferably have an average particle size of between about 1 nm and about 200 nm. Such nanoparticles can readily be disposed into formations and/or perforations therein, for example by injecting fluid systems containing the proppants described above wherein the proppant preferably has an average particle size of between about 0.3 microns and about 3 microns.

The nanoparticles or other form of energy transforming material may suitably be formed of a material selected from the group consisting of iron, cobalt, molybdenum, zirconium, nickel, chromium, silicon and the like. Particularly suitable materials are selected from the group consisting of alumina, silica, zirconium oxide, magnesium oxide, titanium oxide and mixtures thereof.

It should be readily appreciated that a method has been provided whereby heat can be generated in the zone 14 surrounding a well bore of well 10 in a formation 12. This advantageously serves to provide for reduction in fluid viscosity and significant improvements in production flow rates.

In addition to disposing proppants of the nanoparticles as described above, it is possible to force, under pressure, a carrier fluid containing the nanoparticles into a porous formation. Furthermore, the proppants and/or nanoparticles may be delivered through the well bore itself or through a separate bore hole proximate to the well bore.

The method of the present invention can be conducted without substantial expenditures, and can be utilized in numerous different types of production well environments.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for heating a subterranean formation, comprising the steps of:

positioning a well to a subterranean formation;

disposing proppants in said formation, said proppants having an average particle size of about 0.3 microns to about 3 microns wherein said proppants being coated with a plurality of nanoparticles having a particle size of between about 1 nm to about 200 nm, said nanoparticles being formed of an energy transforming material selected from the group consisting of iron, cobalt, molybdenum, zirconium, nickel, chromium, silicon and mixtures thereof; and exposing said energy transforming material to energy whereby said material generates heat for heating the formation.

2. A method for heating subterranean formation, comprising the steps of:

positioning a well to a subterranean formation;

disposing proppants in said formation, said proppants having an average particle size of about 0.3 microns to about 3 microns wherein said proppants having a plurality of nanoparticles inside the proppants, said plurality of nanoparticles having a particle size of between about 1 nm to about 200 nm, said nanoparticles being formed of an energy transforming material selected from the group consisting of iron, cobalt, molybdenum, zirconium, nickel, chromium, silicon and mixtures thereof; and exposing said energy transforming material to energy whereby said material generates heat for heating the formation.

3. The method according to claim 1 or 2, wherein said well defines a well bore passing through said formation, and wherein said disposing step positions said energy transforming material in said formation in a well bore zone extending radially from said well bore, whereby said exposing step heats said well bore zone.

4. The method of claim 1 or 2, further comprising fracturing said formation so as to provide fractures, and wherein said disposing step comprises positioning said proppant in said fractures.

5. The method of claim 1 or 2, further comprising perforating said formation so as to provide perforations, and wherein said disposing step comprises positioning said proppant in said perforations.

6. The method of claim 1 or 2, wherein said exposing step comprises positioning an energy generator in said well and operating said energy generator so as to expose said material to said energy.

7. The method of claim 1 or 2, further comprising the step of producing formation fluids from said formation while carrying out said exposing step whereby said formation fluids are heated by said energy transforming material.

* * * * *

UNITED STATES PATENT AND TRADEMARK OFFICE

CERTIFICATE OF CORRECTION

PATENT NO. : 6,607,036 B2
DATED : August 19, 2003
INVENTOR(S) : Aaron Ranson et al.

It is certified that error appears in the above-identified patent and that said Letters Patent is hereby corrected as shown below:

Column 4,
Line 18, after the word "heating" insert the word -- a --.

Signed and Sealed this

Twenty-ninth Day of June, 2004

JON W. DUDAS
*Acting Director of the United States Patent and Trademark Office*